United States Patent [19]

Johnson

[11] 4,047,416

[45] Sept. 13, 1977

[54] UNCOILING AND STRAIGHTENING APPARATUS FOR STRIP MATERIAL

[75] Inventor: Kenneth C. Johnson, Des Plaines, Ill.

[73] Assignee: F. J. Littell Machine Company, Chicago, Ill.

[21] Appl. No.: 732,324

[22] Filed: Oct. 14, 1976

[51] Int. Cl.[2] ..... B21D 1/02

[52] U.S. Cl. ..... 72/183; 72/161; 242/786

[58] Field of Search ..... 72/183, 160, 161, 164, 72/163; 242/78.6–78.8

[56] References Cited

U.S. PATENT DOCUMENTS

| | | | |
|---|---|---|---|
| 2,527,976 | 10/1950 | Vignere | 72/161 |
| 3,343,393 | 9/1967 | Groll | 72/183 |
| 3,461,703 | 8/1969 | Ranney | 72/183 |
| 3,715,903 | 2/1973 | Huber et al. | 72/183 |

FOREIGN PATENT DOCUMENTS

| | | | |
|---|---|---|---|
| 1,499,337 | 9/1967 | France | 242/78.6 |

*Primary Examiner*—Milton S. Mehr
*Attorney, Agent, or Firm*—Russell H. Clark

[57] ABSTRACT

In the uncoiling and straightening apparatus of the invention, the leading edge of the uncoiled strip material is caused to pass through a straightening machine which is supported for pivotal movement on a horizontal axis so that the machine may be moved to and from horizontal and inclined positions. The shaft providing the horizontal axis also supports a roller and the strip material is caused to contact the roller when the straightening machine is operating in an inclined position. Also to facilitate the uncoiling and bending operations on the material, a stripping apron and a back-breaker roller are incorporated in the apparatus, with the said stripping apron having pivotal movement on the said horizontal axis.

11 Claims, 10 Drawing Figures

UNCOILING AND STRAIGHTENING APPARATUS FOR STRIP MATERIAL

The invention relates to apparatus for handling metal strip material such as may have considerable thickness and has reference more particularly to uncoiling and threading apparatus for unwinding heavy coils of metal stock and for directing the leading edge of the uncoiled material to straightening and feeding mechanism mounted for pivotal movement.

In unbanding and also in unwinding coils of heavy stock material considerable difficulty may be encountered unless adequate precautions and safe procedures are employed. The internal convolutions of the coil contain an infinite number of variables such as internally stored energy, stresses and physical size. Also certain problems exist in the handling of the uncoiled material since it is required that the material be threaded into and passed through a straightening machine for primarily removing the natural curvature of the material due to its presence in the coil and for producing a relatively flat continuous strip of metal capable of being moved in a relatively straight path for feeding to other machines for subsequent operations.

In view of the foregoing, one objective of the present invention resides in the provision of means for supporting and elevating the coil in combination with cooperating means including a hold-down and power driven roller located diametrically opposite the support for contact with the coil thus confining the same therebetween for safety purposes and for control of the coil while the same is unwinding Another object is to provide a power actuated stripping finger for initially engaging and stripping the material from the coil as the same rotates and wherein said stripping finger is carried by a pivotally mounted supporting apron in a manner whereby the finger has reciprocating movement in a direction towards and from the coil.

Another object of the invention resides in the provision of uncoiling and straightening apparatus as described wherein the strip material unwinding from the coil is directed to straightening mechanism which will be pivotally supported from the frame structure so as to have a substantially horizontal threading position and a downwardly inclined operating position.

A further object is to provide apparatus for handling heavy coils of metal wherein the straightening and feeding machine will be pivotally supported and power actuated to and from horizontal and inclined positions and wherein the supporting apron for the stripping finger and also the support for the straightening machine are both mounted for pivotal movement on the same horizontal axis.

Another object of the present invention is to provide a base supported and pivotally mounted straightening machine which is capable of movement to and from horizontal and inclined positions and wherein the hydraulic powered cylinders provided for elevating the straightening machine into a horizontal position can be locked hydraulically whereby to hold the straightening machine in any position between maximum horizontal and inclined positions.

In combination with the straightening machine the invention additionally provides a tubular roller which is journalled for rotation on the same horizontal axis on which the supporting apron for the stripping finger and also the support for the straightening machine are pivotally mounted, whereby the strip material as it unwinds from the coil passes over and has contact with the roller when the straightening machine is in an inclined operating position to facilitate entrance of the strip between the pinch rolls of the straightening machine.

Another object of the invention is to provide roller equipped elevating and supporting saddles for the coil in combination with full width hold-down roller located over the coil and capable of applying pressure thereto for control of the coil. The hold down roller may be held against rotation or the same may be rotated to rotate the coil to assist in removing the metal restraining bands and to additionally assist in orienting the coil for initial action by the stripping finger.

A further object is to provide apparatus as described wherein the horizontal mounting and pivotal support for the straightening machine to enable a horizontal threading position and inclined operating positions is highly desirable from an operating standpoint since the operator has the ability to position the straightening machine at any angle between maximum up and down positions whereby to obtain the most desirable angle for uncoiling coils of different diameter.

An additional object is to provide apparatus of the present character with an accumulation pit for accommodating a free loop of the material as a reserve and which will also incorporate a collapsible table located over the accumulation pit and which in operable position will support an inital length of the strip material and generally direct the same to the feeding rolls of the press.

With these and various other objects in view, the invention may consist of certain novel features of construction and operation as will be more fully described and pointed out in the specification, drawings and claims appended thereto.

In the drawings which illustrate one embodiment of the device and wherein like reference characters are used to designate like parts;

Figure 1:
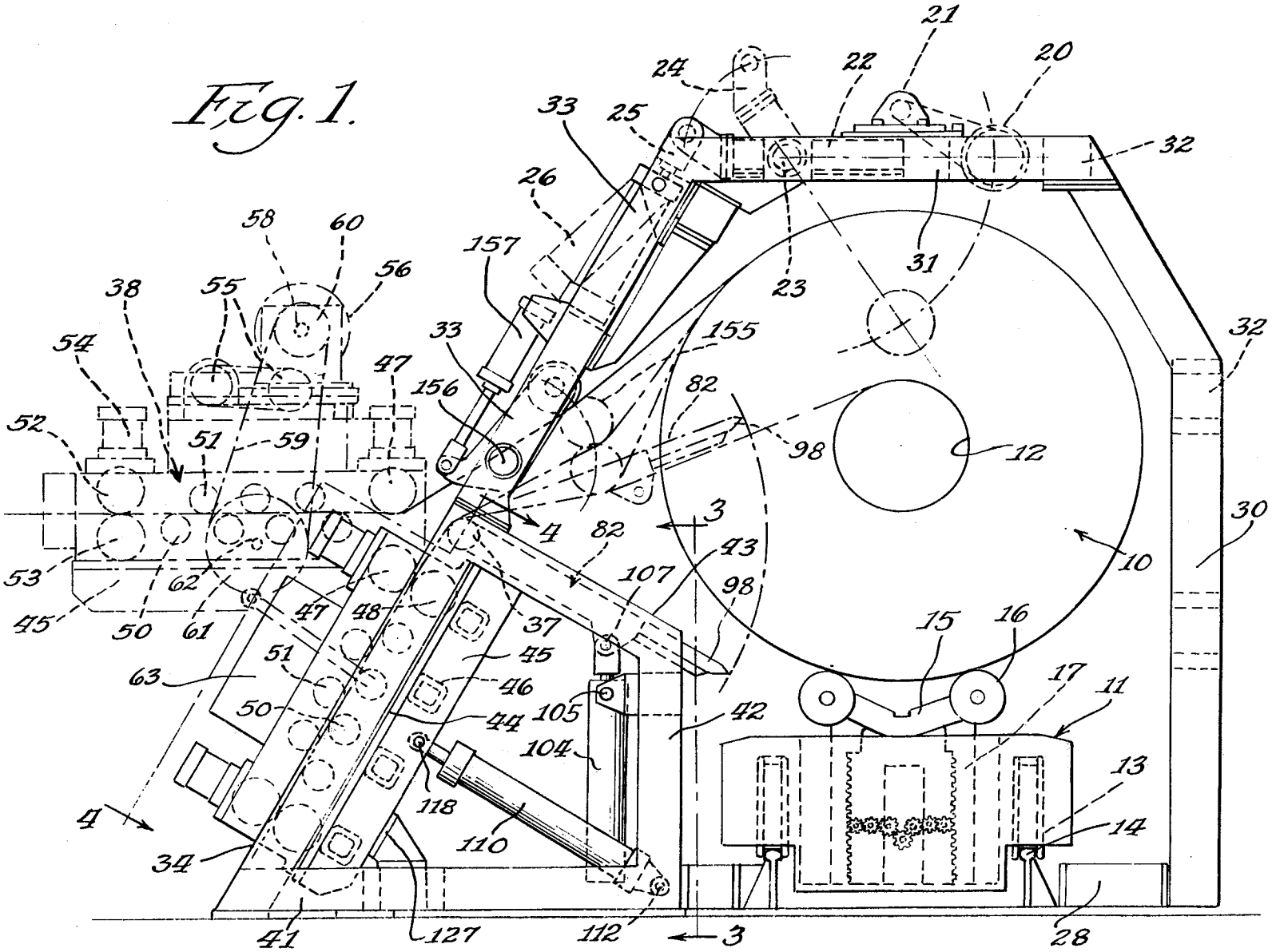
FIG. 1 is a side elevational view showing the complete assembly of the uncoiling and straightening apparatus of the invention, with some parts being shown in dual positions.
Figure 2:
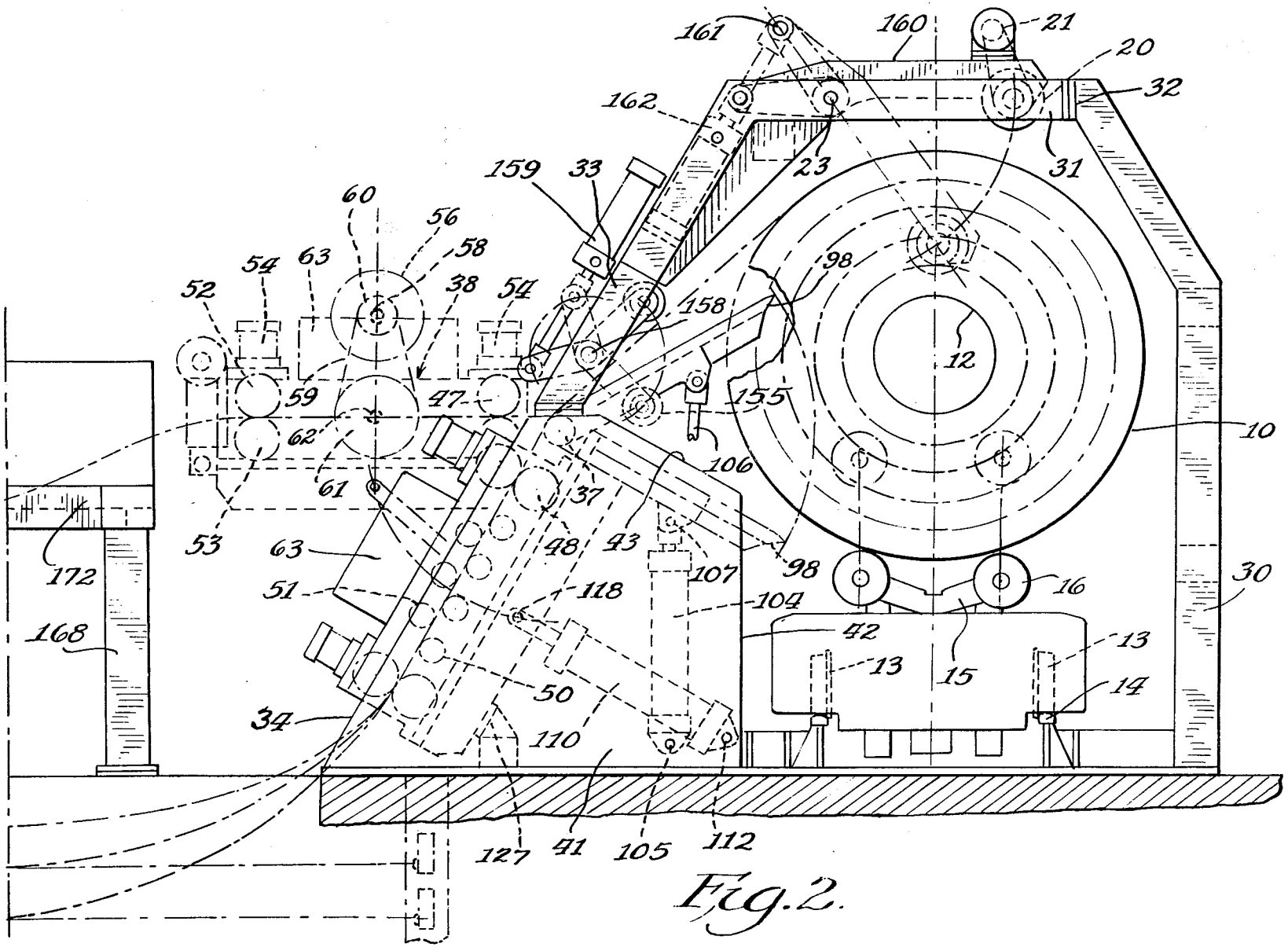
FIG. 2 is a side elevational view similar to FIG. 1, but showing certain modified features, more particularly the actuating means for the hold-down roller and the back-breaker roller.

FIGS. 1 and 2 show the heavy metal coil 10 in supported position over a loading car generally identified by numeral 11. So that the coil can be rotated for unwinding purposes, additional supporting and rotating means must be provided all as well known in the art, and for this purpose a reel of the cantilever trunnion type may be employed such as shown in the Littell et al U.S. Pat. No. 2,598,398 granted May 27, 1952. The radially expanding arms of the trunnion enter the central core opening 12 of the coil and the coil is thus supported within the metal frame, to be presently described, so that the coil can be rotated, held against rotation or rotated in a reverse direction. The loading car 11 for the coil 10 is conveniently supported by the car wheels 13 for rolling movement on the rails 14 and in addition thereto the saddle 15 having the idler rollers 16 can be elevated and lowered by the gear and mechanism 17 which may be motor driven. By means of the gear and rack mechanism the saddle can be moved in an upward direction and thus pressure can be applied to a coil forcing the same into contact with the full width hold down-roller 20. FIGS. 1 and 2 show pivotal positions of the hold down roller 20.

Said roller is powered by the motor 21 to cause the roller to rotate. The pivot shaft 23 carries the arms 22 for the motorized hold-down roller. Said arms each have a rear extension 24 and which is connected to the clevis 25 forming part of the piston rod of the pivotally supported power cylinder 26. When desired, the power cylinder can be energized to force the hold-down roller into pressure contact with the coil. By applying top pressure to the coil better control of the same can be obtained. It may be mentioned that the internal convolutions of the coil are under enormous stresses tending to cause the coil to explode after the encircling bands are cut. The pressure control as above described is important to the operator and it helps to insure his safety.

Figure 3:
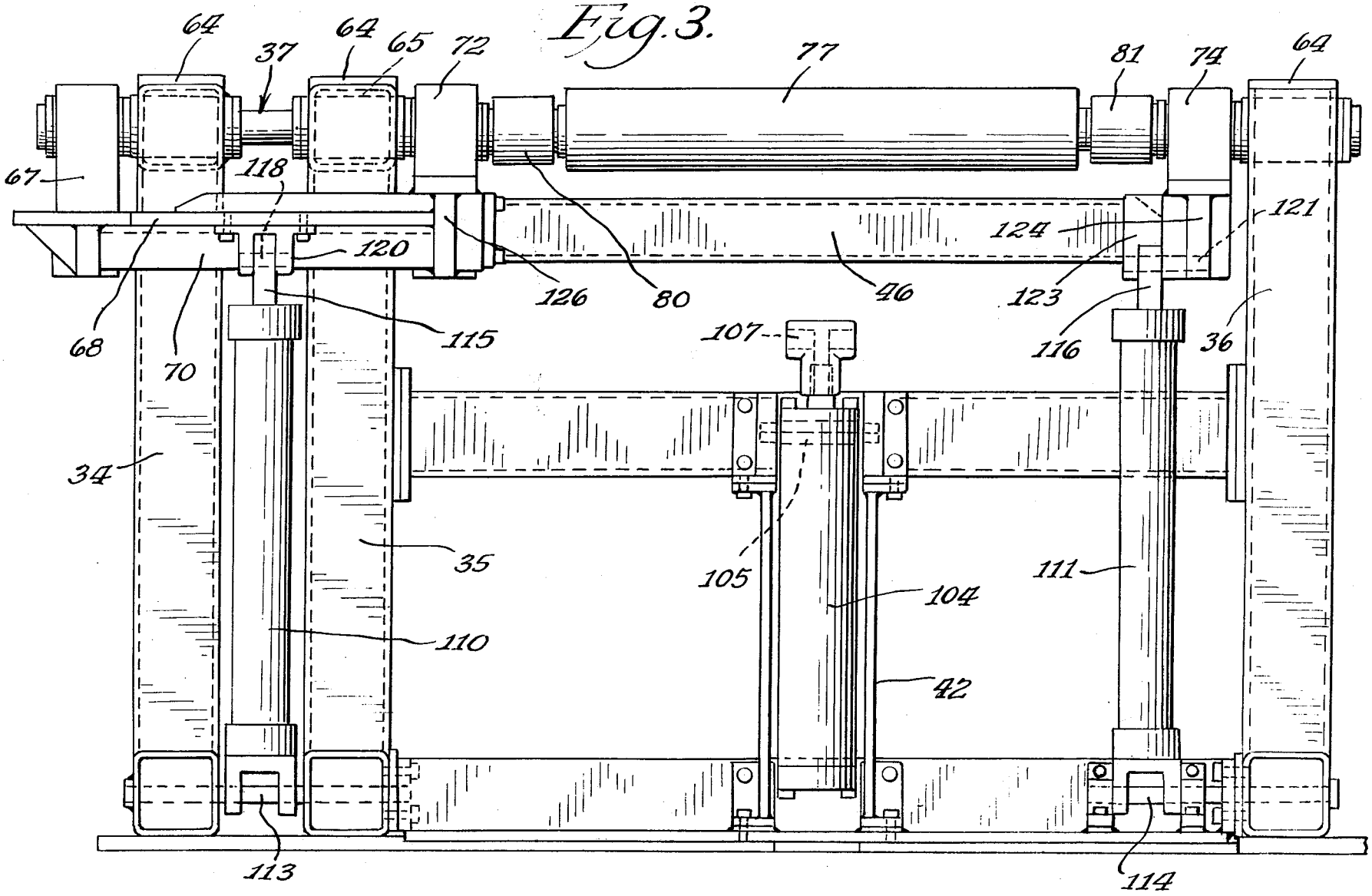
FIG. 3 is a partial vertical view taken substantially on line 3—3 of FIG. 1 and showing the base side of the straightening machine together with the pivoting structure for said machine and the tubular roller mounted for rotation on the same axis, said view additionally showing the power means for respectively oscillating the straightening machine and the stripper finger apron.
Figure 4:
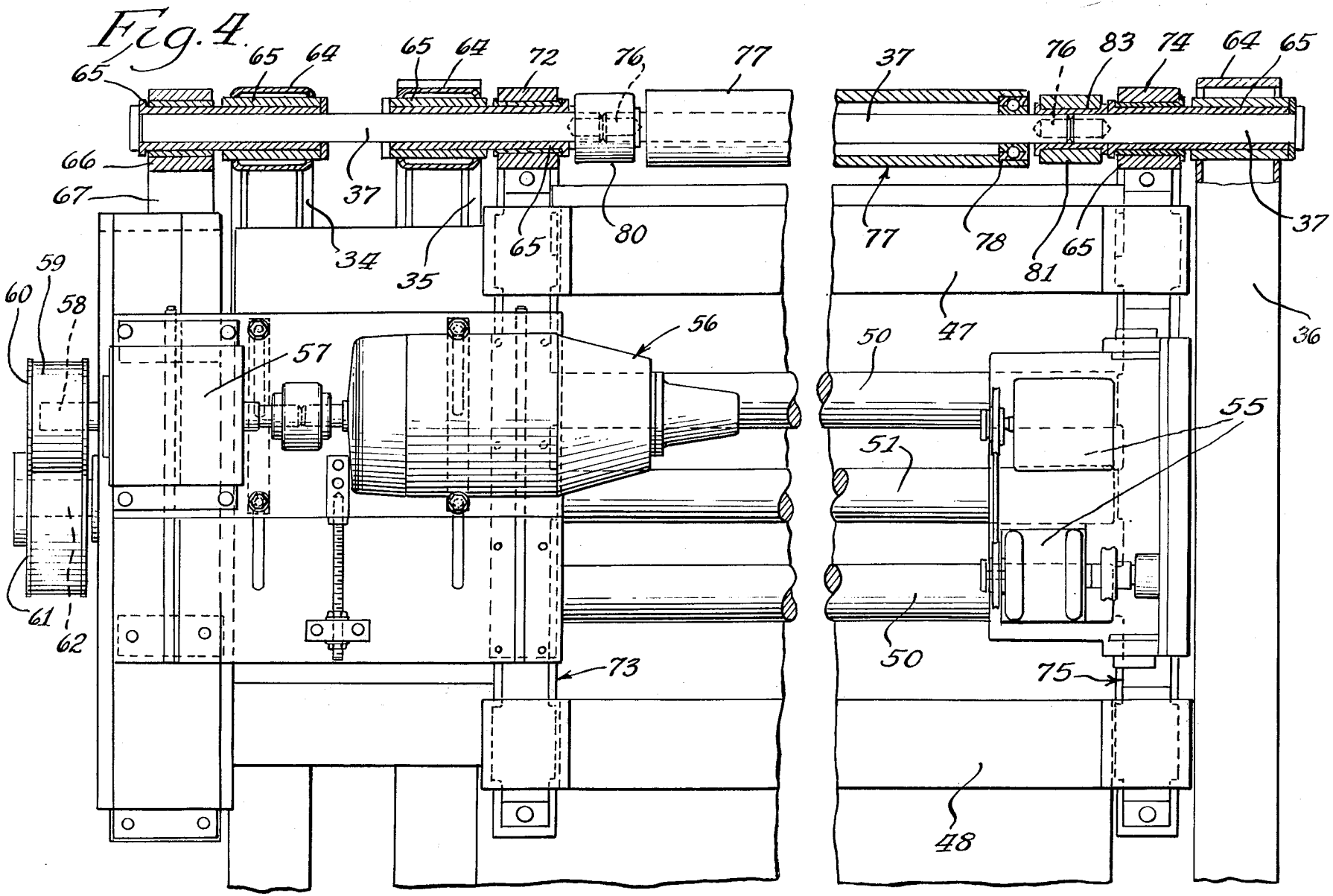
FIG. 4 is an elevational view, with some parts in section, taken substantially on line 4—4 of FIG. 1 and showing in detail the structure provided by the supporting frames for pivotally mounting the straightening machine and additionally showing certain features of said machine.

The operator is further protected by the enclosing frame structure for the coil and which may be generally termed an "A"frame. Base members 28 are located adjacent the rails 14 and on the right side as shown in FIG. 1 the rear supporting frames 30 connect therewith. Two such frames are employed, one on each side of the coil, and at their upper end each frame 30 is joined by a top frame 31 and by a transverse connecting frame piece 32. The frames 31 provide a support for the pivot shaft 23 which carries the arms 22 for the motorized hold-down roller 20. The arms 22 each have a rear extension 24 and which is connected to the clevis 25 forming part of the piston rod of the pivotally supported power cylinder 26. The said top frames 31 are also joined by the front sloping frame member 33. At this corner of the frame structure transverse connecting members such as 32 are also employed in addition to those employed for the members 30 to thus form a rigid and strong supporting frame structure. Said front diagonally sloping members 33 suitably connect immediately above the axis 37 with similar members 34, 35 and 36 of a secondary frame structure as shown in FIGS. 3 and 4. The secondary frame supports the straightening and feeding machine 38 for pivotal movement on said horizontal axis 37 and the three main supporting members 34, 35 and 36 are respectively joined together and to bottom members 41 of said secondary frame structure which also includes the connected uprights 42 and the top connecting members 43. Whereas frame elements 30, 31 and 33 are duplicated on each side of the structure, the three main supports are provided to insure a rugged, strong and durable frame for pivotally mounting and supporting the straightening machine 38.

The said machine is conventional in structure and in operation. A more specific disclosure may be found in U.S. Pat. No. 3,289,448 granted to Chester Wiig on Dec. 6, 1966. For purposes of the invention the straightening machine is mounted on a base 44 consisting of said frame pieces 45 and connecting tubular members 42. At the entrance end, as regards the strip material, two coacting pinch rolls 47 and 48 are suitably journalled by the machine and beyond said pinch rolls the machine also journalls the lower straightening rolls 50 and the upper bodily movable straightening rolls 51. The bite of the rear pinch rolls and also that of the forward pinch rolls 52 and 53 can be adjusted by means located within the housing members 54. The lower rolls 50 rotate only, and they do not move bodily in a vertical direction as do the upper rolls 51. This movement of the upper rolls is possible since their journal bearings are carried by bearing blocks mounted for movement towards and from their coacting lower rolls. The adjustment of the upper straightening rolls to control the action of the machine on the strip material is controlled by mechanism 55 generally shown in FIG. 4 and by dotted lines FIG. 1.

The numeral 56 indicates the driving motor of the straightening machine which has operative driving relation with the speed reducer 57 providing the drive shaft 58. The belt 59 passes around pulley 60 and around the pulley 61 whereby to drive the gear shaft 62 from said drive motor 56. The gears which operatively connect all the straightening rolls and also the pinch rolls with the shaft 62 are housed within the gear box 63, FIG. 1.

Figure 10:
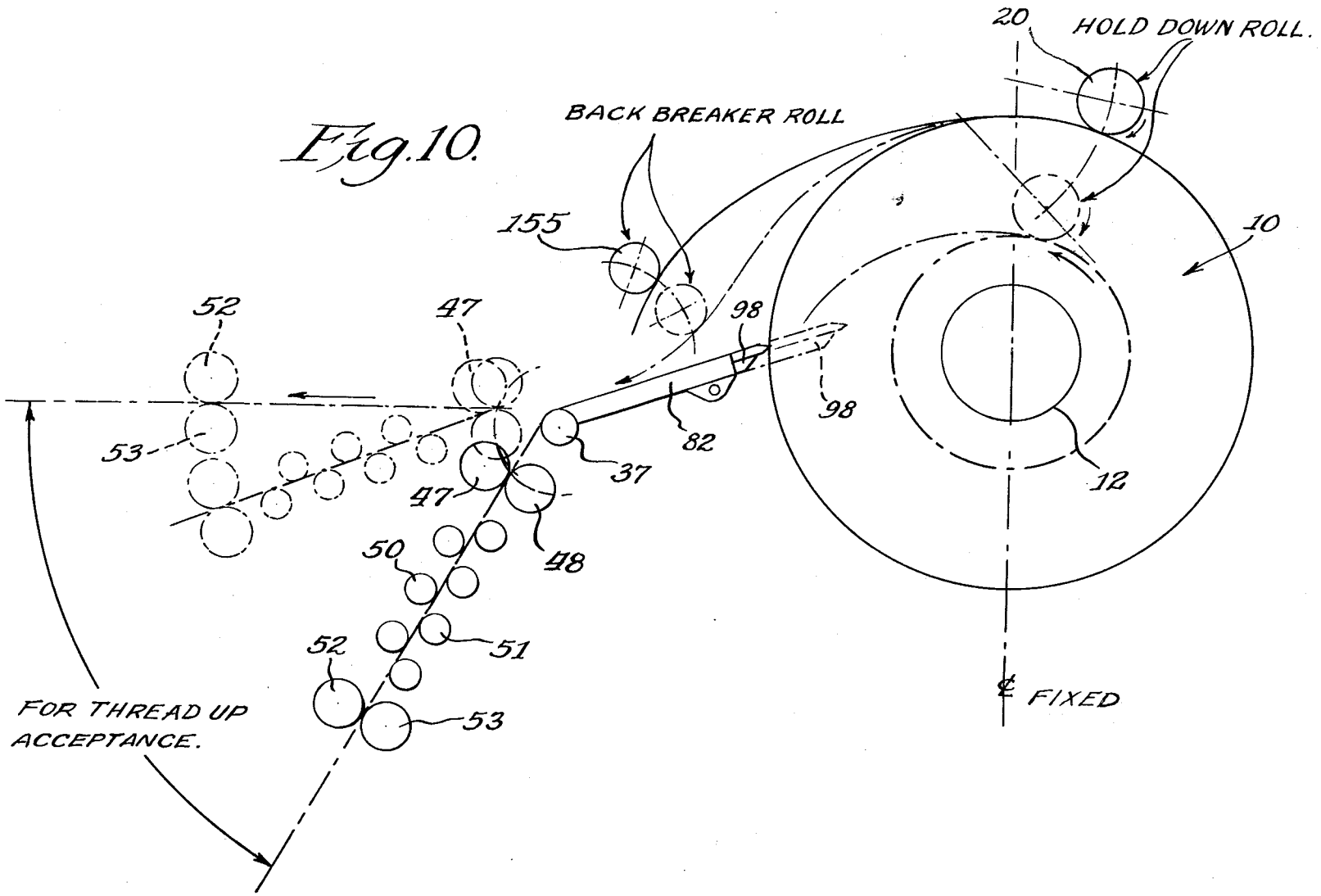
FIG. 10 is a view diagrammatically showing the pivotally supported straightening machine in a horizontal, intermediate and an inclined position and further illustrates the action of the same in receiving and progressing the strip material.

As diagramatically illustrated in FIG. 10, the straightening machine 38 is pivotally supported for movement to and from inclined and horizontal positions on horizontal axis previously designated by numeral 37. Referring more particularly to FIGS. 3 and 4, the horizontal shaft 37, which forms said axis, is journalled in each of the frame supports namely 34, 35 and 36. The support 34 at its upper end receives the journalling member 64 and this in turn receives the bushing 65 through which the left hand section of shaft 37 extends. The support 67 near its lower end has the plate section 68 secured thereto, FIG. 3, and which is reinforced by the side frame part 70. The plate section and side frame part are secured to each other and they extent to the right for securement to the rib structure 126 to be subsequently referred to and which is secured to journalling part 72. The shaft 37 extends from the support 34 to the left and passes through the journalling section 66 of said frame part 67. In this manner the left hand portion of the straightening machine is pivotally mounted on shaft 37. This left hand portion of the machine provides the support for the motor 56 and for the gear box 63 and other driving and regulating means of the machine. In a similar manner the frame support 35 at its upper end receives a journalling member 64 which in turn receives a bushing 65. The bushing extends into and through the journalling section 72. Also the left section of the shaft 37 passes through the bushing and into and through the journalling section 72 of the left side frame part 73 of the machine. Again and in a similar manner the right hand frame support 36 at its upper end receives a journalling member 64 which in turn receives a bushing 65, and this structure in turn supports the right hand section of the shaft 37. The bushing 65 extends to the left to pass through the journalling section 74 provided by the right hand frame member 75 of the straightening machine. The bushing and also the shaft extend a short distance beyond in a left hand direction. Accordingly the frame structure of the straightening machine is supported and pivotally mounted on the shaft 37 by the journalling members 66, 72 and 74 provided by the side frames of the machine, namely 67, 73 and 75. Whereas the left side frame 73 is pivotally mounted adjacent frame support 35, the right side frame 75 is pivotally mounted adjacent the frame support 36.

Figure 7:
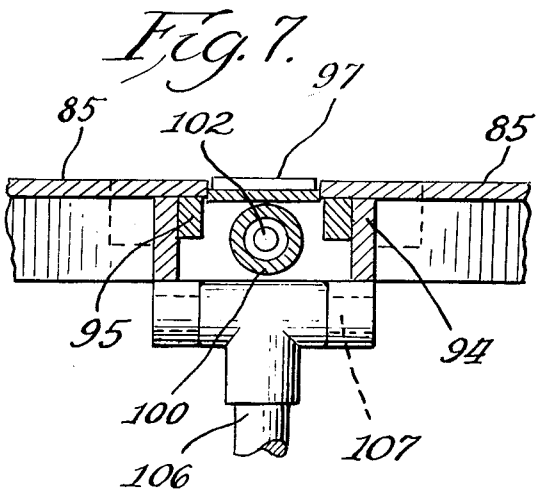
FIG. 7 is a detail sectional view taken substantially on line 7—7 of FIG. 6.
Figure 5:
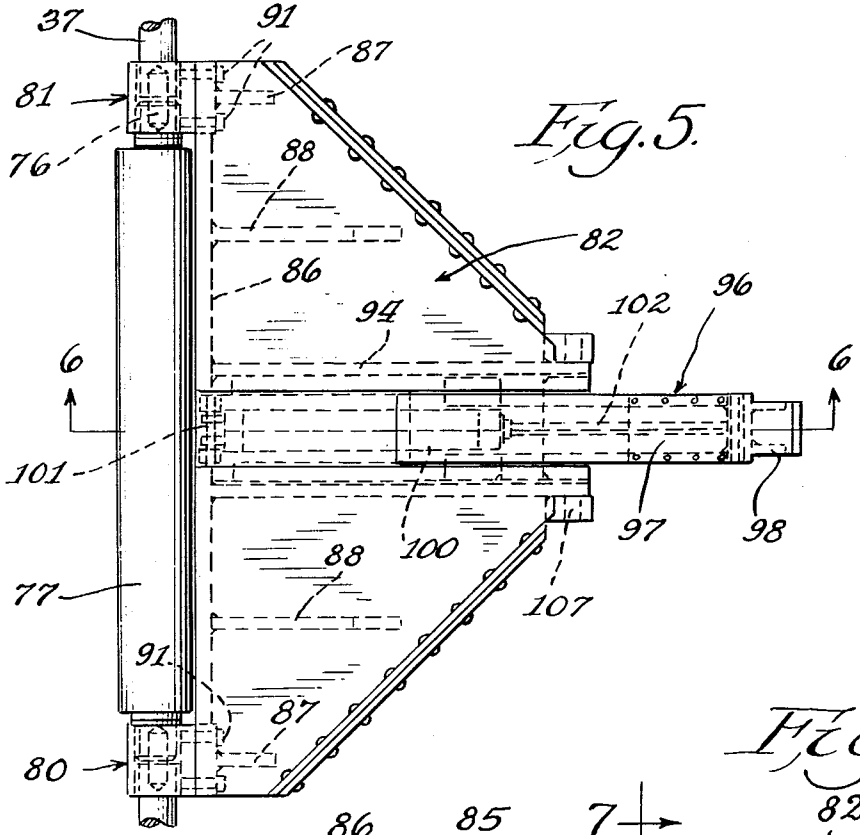
FIG. 5 is a top plan view of the stripping finger apron with the stripping finger in supported relation thereon.
Figure 6:
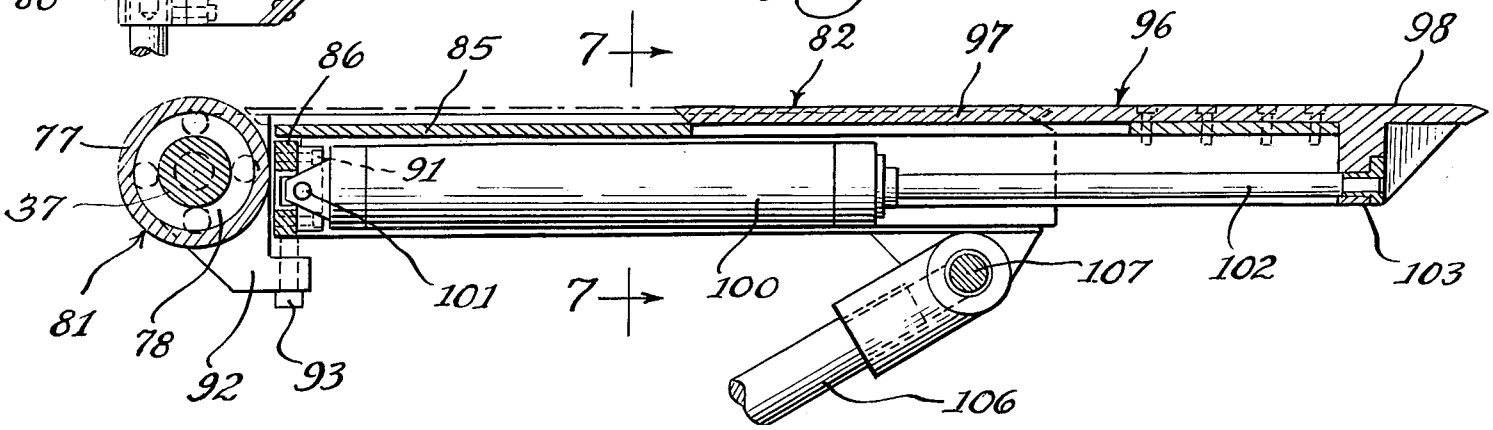
FIG. 6 is a longitudinal sectional view taken substantially along line 6—6 of FIG. 5 and showing structural details of the reciprocable stripping finger and its actuating power cylinder.

Although the shaft 37 is shown in FIG. 4 as comprising three sections, it could of course be a single one piece unit. The combination of sections which are joined by dowel pins 76 helps to facilitate assembly of the several parts including the roller 77. The roller is mounted on the control section of shaft 37 by means of the roller bearings 78. On each side outwardly of the roller the shaft carries the journalling sections 80 and 81 of the stripping finger apron 82 shown in some detail in FIGS. 5, 6 and 7. Each journalling section of the apron is provided with the conventional bushing 83 and the structure enables the apron to have pivotal movement on the same shaft which pivotally supports the straightening machine and which also carries the rotatable roller 77.

The apron 82 is a built up unit consisting essentially of a top plate 85 approximately in the shape of an equilateral triangle having the rear wall 86 depending from its base end and also having several depending reinforcing ribs such as 87, 88 and 90 on each side of the center line. A stripping finger 96 to be presently described projects from the apex of the triangular apron. The ribs 87 at respective sides are also integral with the rear wall 86 and these portions of the rear wall are secured to the journalling sections 80 and 81 by the threaded screws 91. Also each section includes the integral depending hook part 92 best shown in FIG. 6, and which receives the threaded screw 93 to securely join the sections along with the screws 91 to the apron each as a unit. The built up apron also includes the spaced reinforcing ribs 94 extending centrally to form a passage and which provide the spaced gibs 95 within the passage. The gibs guide and direct the stripping finger 96 which has reciprocating movement with respect to the said apron. The finger 96 is also built up of several parts including a longitudinal plate like top wall 97 and a forward blade member 98 suitably secured to the top wall 97 and to other parts of the finger 96.

The finger is capable of movement in a forward direction for stripping purposes and in a rearward direction to locate the finger in an inoperative position. The power means for the finger and the blade forming part of the same consists of the power cylinder 100 pivoted at 101 to the rear wall 86 of the apron and being located within the passage formed by the spaced ribs 94 and the gibs 95. The piston rod 102 of the cylinder extends forwardly and is connected at 103 to the blade 98. In addition to the stripping finger being powered for reciprocating movement, the entire apron is powered for pivotal movement on the pivot shaft 37 by the power cylinder 104 shown in FIG. 4. The cylinder is pivotally supported at 105 and the piston rod 106 of the cylinder connects with the under side of the apron at 107. The apron can be elevated so as to position the stripping finger in proper relation for a stripping action on the coil. When the straightening machine is in an inclined position, the stripping finger can then be retracted and the apron lowered into an inoperative position since the finger is not needed after a threading action has been completed.

The straightening machine 38 is powered into its inclined and horizontal positions by power cylinders preferably of the hydraulic type and generally designated by the numerals 110 and 111 shown in FIGS. 1, 2 and 3. The cylinder end of each power device is pivoted at 112 to the A frame structure, the pivot members 113 and 114 being best shown in FIG. 3. The power cylinders include a piston which rides within the cylinder and to which is fixed a piston rod, 115 for cylinder 110 and 116 for cylinder 111. The piston rod 115 is pivotally secured by pivot pin 118 to the connection 120 having securement to and depending from the base frame part 70 of the straightening machine and which is additionally reinforced by the rib structure 126. The piston rod 116 is likewise pivotally connected to the straghtening machine by the pivot pin 121 mounted in the frame part 123 provided by the base structure on which the machine is mounted and said pivot pin 121 extends into and is additionally anchored by the rib 124 depending from the journalling part 74 of the right hand frame part 75 of said machine.

The power cylinders anchored to the frame structure A at their cylinder ends and having their piston rods pivotally connected to the base of the pivotally mounted straightening machine provide effective and efficient power means for raising and lowering the straighteing machine. Each cylinder has valved ports on respective sides of the piston for the entrance and exit of the high pressure hydraulic medium. When the hydraulic medium is admitted to the space below the pistons the piston rods are extended to elevate the straightening machine, the maximum elevated position being of course the horizontal position. When the medium is exhausted from the space below the piston and admitted to the space behind the piston, the piston rod will move down under control to lower the straightening machine into any desired inclined position. When the maximum inclined position is reached the machine is caused to contact and rest on the pad 127. The straightening machine can be held in contact with the pad by closing the valved ports thus trapping the hydraulic medium on both sides of the pistons. Also the machine can be held in a desired inclined position by a similar closing of the valved ports.

As shown in FIGS. 1 and 2, a back-breaker roller 155 is employed for bending the metal strip material reversely to its curvature which it assumes when on the coil. The back-breaker roller contacts the material as it passes over the stripping apron 82. A reverse bending of the material facilitates its movement in a substantially flattened condition into the pinch rolls 47 and 48. The roller 155 is carried by a bracket pivoted at 156 and powered into and from operating positions by the power cylinder 157.

FIG. 2 shows in side elevation a straightening and a feeding machine similar to FIG. 1 but having several minor modifications such as the power means for actuating the back-breaker roller 155. In this view the said roller is carried by the arm structure pivoted at 158 and connecting with the piston rod of the power cylinder 159. In FIG. 2 a modified arrangement is also provided for the hold-down roller 20. The arm structure 160 which carries the roller is pivoted at 23 and beyond the pivot the same has connection at 161 with the piston rod of the power cylinder 162. The hold-down roller is powered by the motor 21 to effect rotation of the same and hold down pressure can be applied by the roller upon operation of the power cylinder 162.

Figures 8, 9:
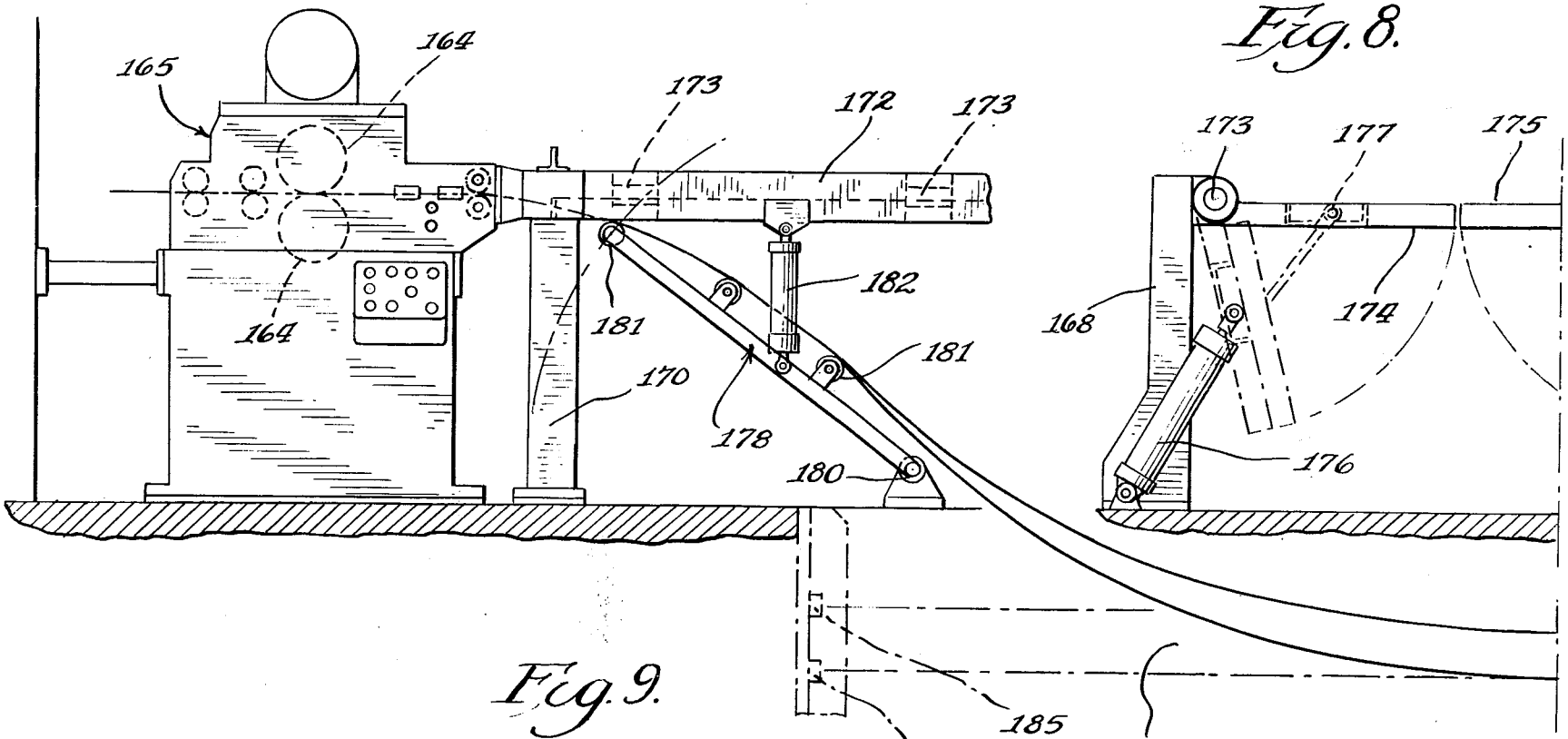
FIG. 8 is a partial view taken transversely of the collapsible table which is located over the accumulation pit.
FIG. 9 is a fragmentary view in side elevation showing the collapsible table and its associated relation with the feeding rolls of the press.

In both forms of the invention, the material is intially stripped from a coil and directed downwardly as illustrated in FIG. 10 and into the bite of the rear pinch rolls 47 and 48. In so doing the strip material passes over, and when the machine is inclined for operation, the material has contact with the roller 77. For initial threading of the strip material in the straightening machine the same is of course positioned horizontally and if necessary the back-breaker roller 155 is employed to facilitate the threading operation. However the machine may be inclined for thread up acceptance and such inclination may vary as shown in FIG. 10. Considerable leeway is thus provided in the downwardly inclined positions of the machine for initially receiving the strip material and which are positions that are favorable for receiving the material as it comes off the coil. When the machine is elevated into a horizontal position, the strip material will travel in a horizontal direction whereby to pass over the table shown in FIGS. 8 and 9. Said table is provided for supporting and directing the initial length of strip material into the feeding rolls 164 of the feeder 165, and in accordance with the invention the table is located over the accumulation pit 171. The table includes the upright posts 168 and 170 positioned in spaced relation transversely as regards the movement of the strip and extending upwards from the floor which provides the accumulation pit 171. The horizontal rails 172 form the sides of the table and which are suitably spaced to accomodate the strip material, the side rails having the hinges 173 on their surfaces for hinging the table sections 174 and 175 resectively, see FIG. 8.

When the table sections are horizontal, the table is complete and the strip material can be supported on the same and caused to move towards the feeding rolls 164. However, during operation of the straightening machine when the same is locked in its inclined position, the table is collapsed by operation of the power cylinders 176, the piston rods of which connect with their respective sections at 177. The table is conveniently located over the accumulation pit since the same are operative at different times. For example, when the table has been collapsed the strip material is free to pass between the transversely spaced posts and accumulate in the pit 171. To facilitate the movement of the strip from the accumulation pit, an auxiliary table 178 is employed and which is pivoted at 180, the table providing the rollers 181 which extend for the full width of the strip. The auxiliary table is raised and lowered by the power cylinder 182.

With the straightening machine 38 in locked operating position, the strip material is ejected from the forward pinch rolls 52 and 53 as a relatively flat and straight processed strip and the same is directed into the accumulation pit 171. The pit thus permits a loop to accumulate before feeding to the rolls of the press. Electronic devices located below the floor level and in line with the loop, control the speed of the straightening machine with respect to the feeding rolls of the press. When the loop exceeds its maximum size then the electronic device 184 is activated to slow down the feeding rate of the straightening machine, and when the loop exceeds its minimum size the electronic device 185 is activated to speed up the action of the straightening machine.

I claim:

1. In uncoiling and straightening apparatus for strip material, the combination with frame structure, of means for supporting a coil of strip material in a manner permitting rotation of the coil, a straightening and feeding machine located on the unwinding side adjacent the coil, said straightening and feeding machine including a pair of pinch rolls at respective ends and a plurality of straightening rolls located between and, when operative, receiving the strip material at one end as it unwinds from the coil and ejecting the same at its other end as a processed relatively flat and straight strip of material, means provided by the frame structure for pivotally mounting the straightening and feeding machine on a horizontal axis, whereby the said machine may have movement to and from inclined and horizontal positions, and power means for moving the machine on said axis into and from said positions.

2. Uncoiling and straightening apparatus for strip material as defined by claim 1, additionally including means in combination with the frame structure for locking the straightening and feeding machine in an inclined operative position.

3. Uncoiling and straightening apparatus for strip material as defined by claim 1, additionally including a stripper finger apron mounted for pivotal movement on the same horizontal axis on which the straightening and feeding machine is mounted, and a stripping finger carried by the apron and adapted to have reciprocating movement in a direction normal to the coil.

4. Uncoiling and straightening apparatus for metal strip material as defined by claim 3, additionally including power means for the stripping finger apron for elevating and lowering the same on its pivot axis, and additional independent power means for producing said reciprocating movement of the stripper finger.

5. Uncoiling and straightening apparatus for metal strip material as defined by claim 4, wherein the additional independent power means for reciprocating the stripper finger is carried by the stripper finger apron.

6. In uncoiling and straightening apparatus for strip material, the combination with frame structure, of means for supporting a coil of strip material for rotation from the frame structure, a straightening and feeding machine for the strip material located on the unwinding side of the coil and having a pair of of coacting pinch rolls at its entering end, means provided by the frame structure for pivotally mounting the straightening and feeding machine on a horizontal axis, whereby said machine may have movement to and from inclined and horizontal positions, and a roller of tubular formation mounted for rotation by the frame structure on the same horizontal axis on which the straightening and feeding machine is pivotally mounted, said strip material as it unwinds from the coil passing over and having contact with the tubular roller before it enters between the pinch rolls of the straightening and feeding machine, when the machine is in an inclined operating position.

7. Uncoiling and straightening apparatus for strip material as defined by claim 6, additionally including power means for moving the straightening and feeding machine into and from said inclined and horizontal positions.

8. Uncoiling and straightening apparatus for strip material as defined by claim 6, additionally including a stripping finger apron mounted for pivotal movement on the same horizontal axis on which the straightening and feeding machine and the tubular roller are mounted, and a stripping finger carried by the apron and adapted to have reciprocating movement in a direction normal to the coil.

9. Uncoiling and straightening apparatus for strip material as defined by claim 8, additionally including power means for the stripping finger apron for elevating and lowering the same on its pivot axis, and additional independent power means for producing and reciprocating movement of the stripping finger.

10. In uncoiling and straightening apparatus for metal strip material, the combination with frame structure, of means for supporting a coil of strip material in a manner permitting rotation of the coil, a straightening and feeding machine located on the unwinding side adjacent the coil, said straightening and feeding machine, when operative, receiving the strip material at one end as it unwinds from the coil and ejecting the same at its other end as a processed relatively flat and straight strip of material, a horizontal pivot shaft provided by the frame structure, means provided by the straightening and feeding machine having a pivotal mounting on the horizontal pivot shaft, whereby the said machine may have pivotal movement into and from inclined and horizontal positions, power means for moving the machine on said pivot shaft into and from said positions, said power means comprising one or more hydraulic cylinders wherein a movable piston within each cylinder is equipped with a piston rod which extends through one end of the cylinder being sealed but movable with respect thereto, said piston rod at its outer free end being pivotally connected to the underside of the straightening machine and means including valved ports for admitting and discharging the hydraulic medium from respective sides of the piston.

11. In uncoiling and straightening apparatus for strip material, the combination with frame structure, of means for supporting a coil of the strip material in a manner permitting rotation of the coil, a straightening machine for the strip material having side frame members and also having a pair of pinch rolls at its entrance end, said straightening machine being located on the unwinding side adjacent the coil, a horizontal pivot shaft provided by the frame structure, a journalling member provided by each side frame member of the straightening machine, said journalling members being mounted in spaced relation on the pivot shaft whereby to pivotally mount the straightening machine on a horizontal axis for movement to and from inclined and horizontal positions, power means in the form of hydraulic cylinders anchored by the frame structure and having their respective piston rods pivotally connected to the underside of the straightening machine for moving the same into and from said positions, and a roller of tubular formation mounted for rotation on the pivot shaft and located between the journalling members, said strip material as it unwinds from the coil passing over and having contact with the roller before it enters between the pinch rolls of the straightening machine.

* * * * *